US009970325B2

(12) United States Patent
Oden et al.

(10) Patent No.: US 9,970,325 B2
(45) Date of Patent: May 15, 2018

(54) JACKING ASSEMBLY FOR ROTOR

(71) Applicant: General Electric Company, Schenectady, NY (US)

(72) Inventors: Joshua Michael Oden, Greenville, SC (US); Michael Helton, Greenville, SC (US); Jason Dixson, Gridley, CA (US)

(73) Assignee: General Electric Company, Schenectady, NY (US)

( * ) Notice: Subject to any disclaimer, the term of this patent is extended or adjusted under 35 U.S.C. 154(b) by 63 days.

(21) Appl. No.: 14/700,878

(22) Filed: Apr. 30, 2015

(65) Prior Publication Data

US 2016/0319665 A1 Nov. 3, 2016

(51) Int. Cl.

| | |
|---|---|
| ***B66F 3/24*** | (2006.01) |
| ***F01D 25/28*** | (2006.01) |
| ***B66F 9/18*** | (2006.01) |
| ***B66C 1/10*** | (2006.01) |
| ***B66C 1/62*** | (2006.01) |

(52) U.S. Cl.

CPC ..... *F01D 25/285* (2013.01); *B66C 1/107* (2013.01); *B66C 1/62* (2013.01); *B66F 3/24* (2013.01); *B66F 9/18* (2013.01)

(58) Field of Classification Search

CPC ..... B66F 3/36; B66F 3/00; B66F 3/24; B66F 3/247; B66F 9/04

See application file for complete search history.

(56) References Cited

U.S. PATENT DOCUMENTS

| | | | | |
|---|---|---|---|---|
| 2,011,408 | A | 8/1935 | Jacobs | |
| 2,963,270 | A | 12/1960 | Magarin | |
| 3,362,160 | A | 1/1968 | Bourgeois | |
| 3,527,442 | A * | 9/1970 | Korkut | E02B 17/0836 254/106 |
| 3,769,190 | A * | 10/1973 | Deem | C23F 13/02 204/196.15 |
| 3,922,907 | A | 12/1975 | Hurwitz et al. | |
| 4,330,105 | A * | 5/1982 | Gallagher | B66F 7/025 254/89 R |
| 4,353,215 | A | 10/1982 | Anderson et al. | |
| 4,451,979 | A * | 6/1984 | Schuster | F01D 25/285 29/281.4 |
| 4,461,455 | A * | 7/1984 | Mills | B64F 5/0036 180/125 |

(Continued)

FOREIGN PATENT DOCUMENTS

| | | |
|---|---|---|
| EP | 0 865 582 A1 | 9/1998 |
| EP | 0 907 077 A2 | 4/1999 |

(Continued)

*Primary Examiner* — Christopher M Koehler
*Assistant Examiner* — Tyrone V Hall, Jr.
(74) *Attorney, Agent, or Firm* — Nixon & Vanderhye P.C.

(57) ABSTRACT

A jacking assembly for a rotor of a turbine includes an arc-shaped saddle which extends around and supports a lower portion of a rotor. A lifting beam extends over the rotor transversely to an axial direction of the rotor. The lifting beam is axially aligned with the arc-shaped saddle. Two connectors are disposed on respective lateral sides of the rotor, each connector extending between and being coupled to the lifting beam and the arc-shaped saddle such that the saddle is configured to lift the rotor vertically when the lifting beam is displaced vertically.

13 Claims, 9 Drawing Sheets

(56) References Cited

U.S. PATENT DOCUMENTS 4,532,689 A * 8/1985 Harder ..... B23P 19/025 29/252
4,741,203 A 5/1988 Willaman et al.
5,102,074 A * 4/1992 Okada ..... F16L 3/24 248/59
5,110,090 A * 5/1992 McDuffie ..... B66F 3/36 254/124
5,573,210 A * 11/1996 Hendrix ..... F16L 3/1091 248/59
6,126,549 A 10/2000 Appell et al.
6,188,218 B1 2/2001 Goldfine et al.
6,631,541 B2 10/2003 Mosing et al.
6,657,429 B1 12/2003 Goldfine et al.
6,952,095 B1 10/2005 Goldfine et al.
RE39,206 E 7/2006 Goldfine et al.
7,121,098 B2 10/2006 Hatcher
7,149,632 B1 12/2006 Gao et al.
7,161,350 B2 1/2007 Goldfine et al.
7,230,421 B2 6/2007 Goldfine et al.
7,236,564 B2 6/2007 Hopkins et al.
7,348,771 B2 3/2008 Goldfine et al.
7,489,811 B2 2/2009 Brummel et al.
7,589,526 B2 9/2009 Goldfine et al.
7,619,728 B2 11/2009 Ogburn et al.
7,734,435 B2 6/2010 Thomas et al.
7,871,064 B2 * 1/2011 Dailey ..... H02K 15/0006 254/89 R
7,900,562 B2 3/2011 Esposti et al.
7,946,157 B2 5/2011 Habets
7,994,781 B2 8/2011 Goldfine et al.
8,095,328 B2 1/2012 Thomas et al.
8,171,809 B2 5/2012 Fritz
8,261,599 B2 9/2012 Jeffrey et al.
8,270,667 B2 9/2012 Fritz et al.
8,322,202 B2 12/2012 Ehehalt et al.
8,510,060 B2 8/2013 Hardwicke et al.
8,640,531 B2 2/2014 Remillard et al.
8,711,999 B2 5/2014 Hatcher
8,744,864 B2 6/2014 Bacon et al.
8,745,888 B2 6/2014 Silliman et al.
8,826,520 B1 * 9/2014 Spanos ..... B23P 19/025 29/596
8,867,787 B2 10/2014 Singamsetti et al.
8,896,661 B2 11/2014 Baleine et al.
8,922,640 B2 12/2014 Hatcher et al.
9,199,830 B2 * 12/2015 O'Brien ..... B66F 3/08
9,421,898 B2 * 8/2016 Huet ..... B60P 1/02
2003/0128736 A1 7/2003 Dalio et al.
2003/0156904 A1 * 8/2003 Kline ..... F16L 1/024 405/154.1
2004/0055138 A1 * 3/2004 Tomko ..... H02K 15/00 29/596
2004/0066188 A1 4/2004 Goldfine et al.
2004/0216468 A1 11/2004 Hatcher
2004/0267720 A1 12/2004 Liu et al.
2005/0027586 A1 2/2005 Bacon et al.
2005/0248339 A1 11/2005 Goldfine et al.
2006/0067471 A1 3/2006 Hopkins et al.
2006/0078193 A1 4/2006 Brummel et al.
2006/0082366 A1 4/2006 Goldfine et al.
2006/0271311 A1 11/2006 Gao et al.
2007/0034805 A1 2/2007 Hopkins et al.
2007/0120561 A1 5/2007 Goldfine et al.
2007/0236214 A1 10/2007 Goldfine et al.
2008/0215270 A1 9/2008 Thomas et al.
2009/0027665 A1 1/2009 Ogburn et al.
2009/0206160 A1 10/2009 Jeffrey et al.
2009/0293596 A1 12/2009 Ehehalt et al.
2009/0315540 A1 12/2009 Goldfine et al.
2010/0050752 A1 3/2010 Habets
2010/0103260 A1 4/2010 Williams
2010/0114502 A1 5/2010 Badami et al.
2010/0211343 A1 8/2010 Thomas et al.
2011/0138937 A1 6/2011 Fritz
2011/0296810 A1 12/2011 Hardwicke et al.
2012/0024068 A1 2/2012 Silliman et al.
2012/0024099 A1 2/2012 Main
2012/0072152 A1 3/2012 Thomas et al.
2012/0076345 A1 3/2012 Fritz et al.
2012/0136630 A1 5/2012 Murphy et al.
2012/0145976 A1 * 6/2012 Hynous ..... B66F 3/08 254/98
2012/0260497 A1 10/2012 White et al.
2012/0279323 A1 11/2012 Broda et al.
2012/0312103 A1 12/2012 Hannott et al.
2013/0083187 A1 4/2013 Xie et al.
2013/0179388 A1 7/2013 Agarwal et al.
2013/0192353 A1 8/2013 Hatcher
2013/0194379 A1 8/2013 Baleine et al.
2013/0194411 A1 8/2013 Baleine et al.
2013/0194412 A1 8/2013 Hatcher et al.
2013/0194413 A1 8/2013 Hatcher et al.
2013/0233064 A1 9/2013 Ono et al.
2013/0269426 A1 10/2013 Remillard et al.
2013/0333201 A1 12/2013 Fogel et al.
2013/0335530 A1 12/2013 Hatcher, Jr. et al.
2013/0335549 A1 12/2013 Hatcher, Jr. et al.
2013/0338938 A1 12/2013 Coultate
2014/0055596 A1 2/2014 Hatcher, Jr. et al.
2014/0063227 A1 3/2014 Baleine
2014/0088887 A1 3/2014 Poon et al.
2014/0088888 A1 3/2014 Poon et al.
2014/0133697 A1 5/2014 Singamsetti et al.
2014/0244328 A1 8/2014 Zhou et al.
2014/0373610 A1 12/2014 Feindel et al.

FOREIGN PATENT DOCUMENTS

EP 1 027 598 A1 8/2000
EP 0 865 582 B1 3/2003
EP 1 027 598 B1 12/2003
EP 1 457 910 A2 9/2004
EP 1 650 583 A2 4/2006
EP 1 408 201 B1 7/2007
EP 2 100 031 A2 8/2008
EP 1 996 807 A1 12/2008
EP 2 023 180 A1 2/2009
EP 2 486 439 A2 9/2011
EP 2 392 983 A2 12/2011
EP 2 533 041 A1 2/2012
EP 2 100 031 B1 4/2012
EP 2 484 892 A2 8/2012
EP 2 710 437 A2 3/2013
EP 2 710 438 A2 3/2013
EP 2 583 262 A1 4/2013
EP 2 653 651 A2 10/2013
EP 2 742 341 A1 6/2014
EP 2 810 055 A1 12/2014
EP 2 810 056 A1 12/2014
EP 2 810 057 A1 12/2014
EP 2 810 115 A1 12/2014
EP 2 810 116 A1 12/2014
EP 2 810 117 A1 12/2014
WO WO 1997/021044 A1 6/1997
WO WO 1999/022231 A1 5/1999
WO WO 2001/022076 A1 3/2001
WO WO 2003/038238 A2 5/2003
WO WO 2007/107395 A1 9/2007
WO WO 2008/046931 A2 4/2008
WO WO 2009/129617 A1 10/2009
WO WO 2010/051128 A1 6/2010
WO WO 2010/051278 A1 6/2010
WO WO 2011/042744 A2 4/2011
WO WO 2012/160371 A2 11/2012
WO WO 2012/160730 A2 11/2012
WO WO 2013/043574 A1 3/2013
WO WO 2013/116006 A1 8/2013
WO WO 2013/116078 A1 8/2013
WO WO 2013/116079 A1 8/2013
WO WO 2013/116080 A1 8/2013
WO WO 2013/116475 A1 8/2013
WO WO 2013/116490 A1 8/2013
WO WO 2014/031955 A1 2/2014

(56) References Cited

FOREIGN PATENT DOCUMENTS

| | | | |
|---|---|---|---|
| WO | WO 2014/031957 | A1 | 2/2014 |
| WO | WO 2014/031974 | A1 | 2/2014 |
| WO | WO 2014/170232 | A1 | 10/2014 |

* cited by examiner

JACKING ASSEMBLY FOR ROTOR

FIELD OF THE INVENTION

This invention relates generally to a rotor jacking assembly, and more particularly to a rotor jacking assembly for jacking up a rotor while in place in a turbine.

BACKGROUND OF THE INVENTION

In turbines and electrical generators, it is necessary to periodically replace the journal bearings of the rotor and to conduct major inspections of the turbine. Known procedures utilize a crane to lift the rotor out of the turbine and to support the rotor while journal replacement or inspections are conducted.

It is labor-intensive to remove the rotor entirely from the turbine and use of a crane is an additional expensive and time-consuming task.

BRIEF SUMMARY OF THE INVENTION

One aspect of the disclosed technology relates to a rotor jacking assembly for jacking up a rotor while the rotor remains in place in the turbine.

Another aspect of the disclosed technology relates to performing a major inspection of the turbine while the rotor is jacked up but still in place in the rotor.

One exemplary but nonlimiting aspect of the disclosed technology relates to a jacking assembly for a rotor of a turbine, comprising an arc-shaped saddle configured to extend around and support a lower portion of a rotor, a lifting beam configured to extend over the rotor transversely to an axial direction of the rotor, the lifting beam being axially aligned with the arc-shaped saddle, and two connectors disposed on respective lateral sides of the rotor, each connector extending between and being coupled to the lifting beam and the arc-shaped saddle, wherein the saddle is configured to lift the rotor vertically when the lifting beam is displaced vertically.

Another exemplary but nonlimiting aspect of the disclosed technology relates to a jacking assembly for a rotor of a turbine, comprising an arc-shaped saddle configured to extend around and support a lower portion of a rotor, an arc-shaped retaining member connected to the saddle and configured to extend around an upper portion of the rotor so as to hold the saddle beneath the lower portion of the rotor, and two lifting devices disposed on respective lateral sides of the rotor, the lifting devices being configured to lift the saddle vertically.

Another exemplary but nonlimiting aspect of the disclosed technology relates to a method for replacing a journal bearing of a rotor of a turbine comprising providing an arc-shaped saddle configured to extend around and support a lower portion of a rotor, lifting the rotor by the saddle vertically to unload the weight of the rotor from the journal bearing while maintaining the rotor in the turbine, and removing at least a lower portion of the journal bearing while the rotor is lifted by the saddle.

Other aspects, features, and advantages of this technology will become apparent from the following detailed description when taken in conjunction with the accompanying drawings, which are a part of this disclosure and which illustrate, by way of example, principles of this invention.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
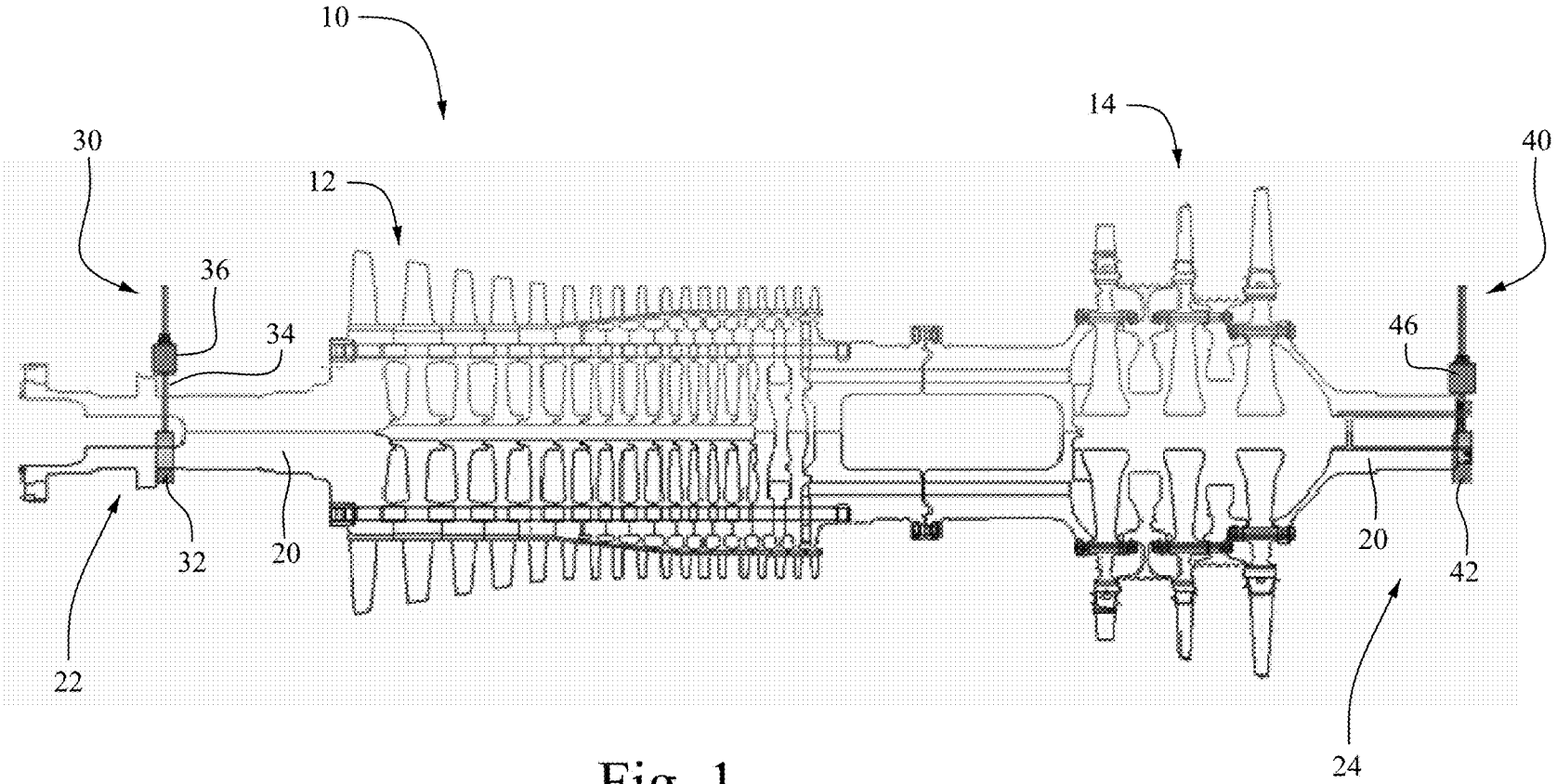
FIG. 1 is a cross-section of a gas turbine according to an example of the disclosed technology.

Referring to FIG. 1, a cross-section of a gas turbine 10 is shown. The illustrated gas turbine 10 includes a combustor section 12 and a turbine 14. As those skilled in the art will recognize, the gas turbine includes other conventional components that are not described here.

The turbine 14 is coupled to the compressor 12 via a rotor or shaft 20. Also shown in FIG. 1 is a forward end jacking assembly 30 for jacking up a forward end 22 of rotor 20. An aft end jacking assembly 40 is shown at an aft end 24 of rotor 20 for jacking up this portion of the rotor.

Figure 2:
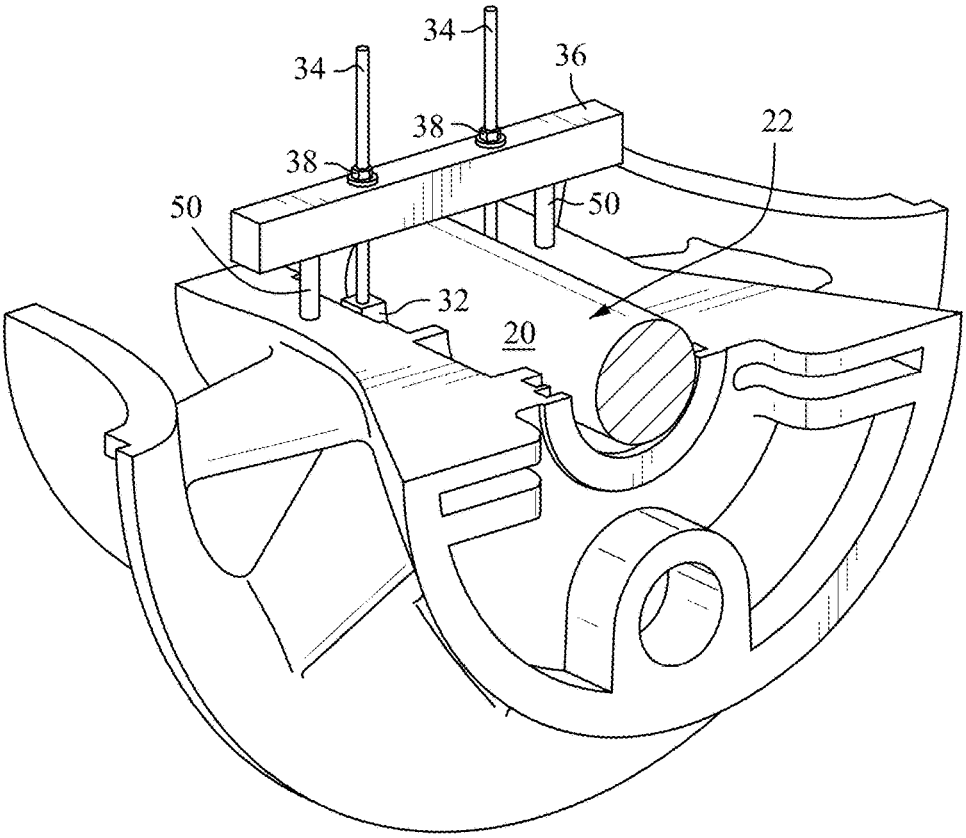
FIG. 2 is a perspective view showing a portion of a forward end of a gas turbine with a jacking assembly according to an example of the disclosed technology.
Figure 4:
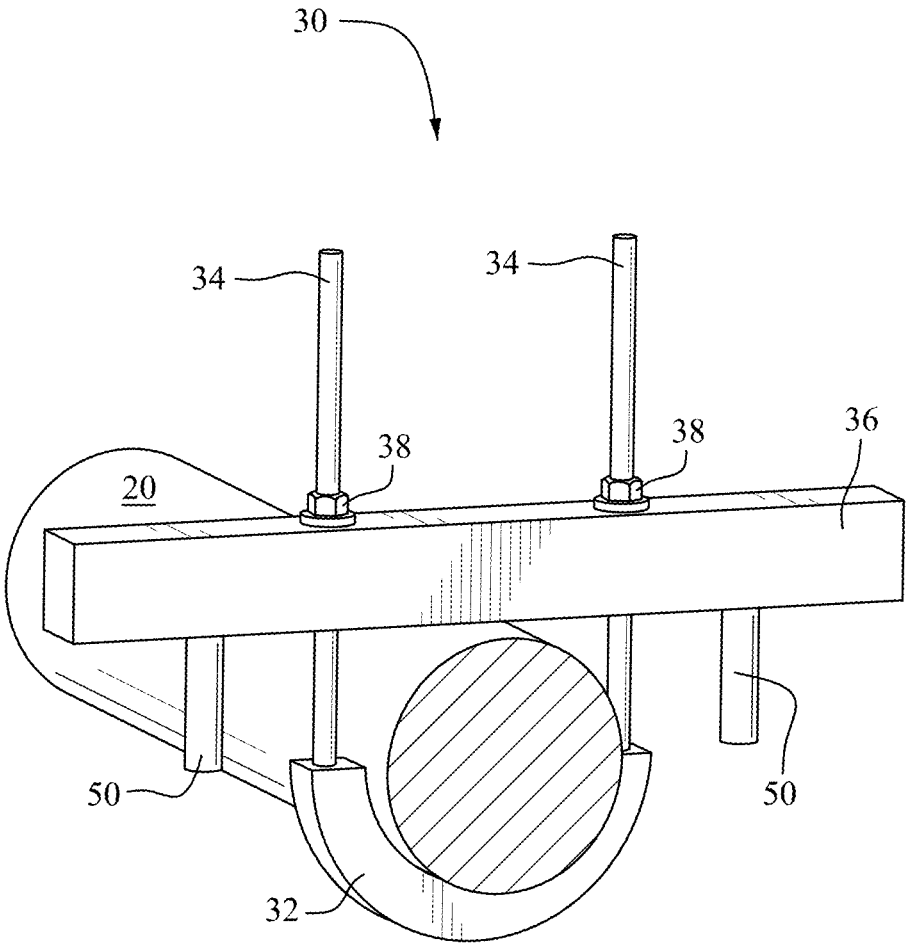
FIG. 4 is a perspective view of a jacking assembly according to an example of the disclosed technology.

As shown in FIGS. 1, 2 and 4, the jacking assembly 30 includes a saddle 32. The saddle 32 has an arc shape and is configured to extend around and support a lower portion of the rotor 20. In the illustrated example, the saddle 32 has a semicircular shape. A pair of connectors 34 are configured to be coupled to opposing ends of the saddle. In the illustrated example, the connectors 34 are threaded rods which are screwed into threaded holes in the upper end faces of the saddle.

The connectors 34 extend through respective through-holes in lifting beam 36, as shown in FIGS. 2 and 4. Locking members (e.g., nuts 38) may be positioned on connectors 34 above and beneath the lifting beam 36 to fix the location of the lifting beam relative to the connectors 34. The lifting beam 36 extends over the rotor 20 transversely to an axial direction of the rotor and is axially aligned with the saddle 32. Lifting beam 36 has an elongate rectangular shape, but those skilled in the art will recognize that the lifting beam may have other shapes (e.g., square).

A lifting device (e.g., mechanical jack 50) is positioned beneath the lifting beam 36 on each side of the rotor. The jacks 50 are configured to support a portion of the lifting beam 36. The jacks 50 are also configured to jack up lifting beam 36 which in turn causes the saddle 32 to lift the rotor.

The jacks 50 use positive stop such that there is essentially no creep down over time. That is, due to their mechanical construction, the jacks can be continually loaded supporting the rotor for long periods of time (e.g., several weeks) with no creep down. The forward 22 and aft 24 ends of rotor 20 may each weight around 50,000 lbs.

Figure 3:
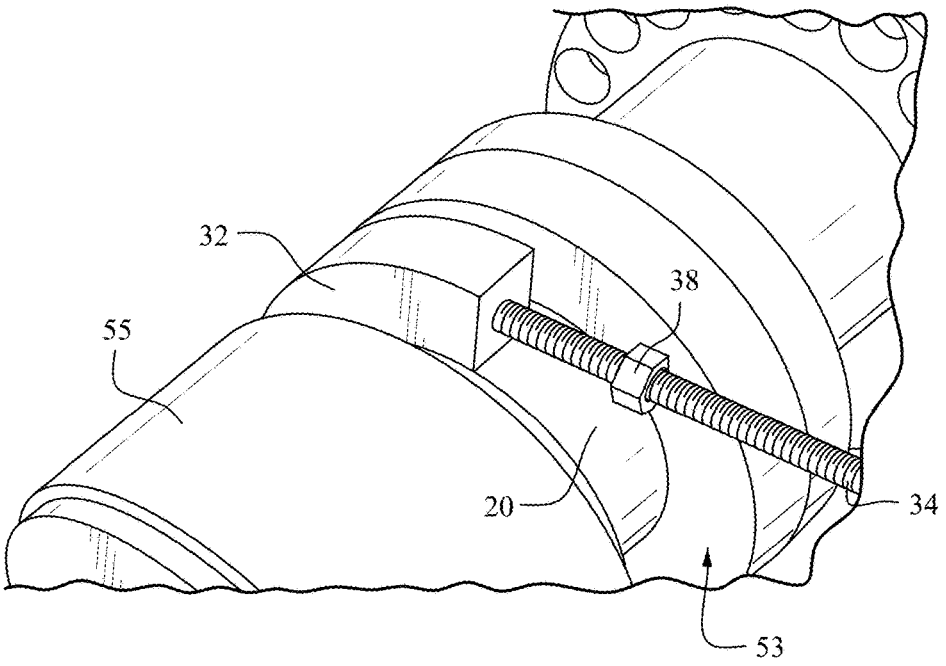
FIG. 3 is a partial perspective view of a saddle being lowed around a forward end portion of the rotor according to an example of the disclosed technology.

As can be seen in FIG. 3, the thrust bearing is removed from the thrust cage cavity 53, in order to provide room to install the saddle 32. The saddle 32 is rotated around rotor 20 until it is positioned beneath the lower portion of the rotor. The upper half 55 of the journal bearing (bearing #1) at the forward end 22 of the rotor may be removed prior to lifting the rotor.

The jacking assembly 30 is configured to lift the rotor a distance of 0.008 to 0.0225 inches (or 0.02032 to 0.5715 mm), preferably 0.01 to 0.02 inches (or 0.254 to 0.508 mm). As such, rotor 20 is not removed from the turbine. Instead, rotor 20 is raised such a small distance that the rotor remains in the turbine while lifted just enough to unload the weight of the rotor from the journal bearing.

Jacking assembly 30 is configured to hold the rotor in the lifted position while the lower half of bearing #1 is removed, inspected or replaced. While the rotor is lifted, a major inspection may be performed on the turbine. For example, steam cleaning tools and borescopes may be used to clean and inspect the lower half stator vanes while the rotor is lifted but still in place in the turbine.

Figure 6:
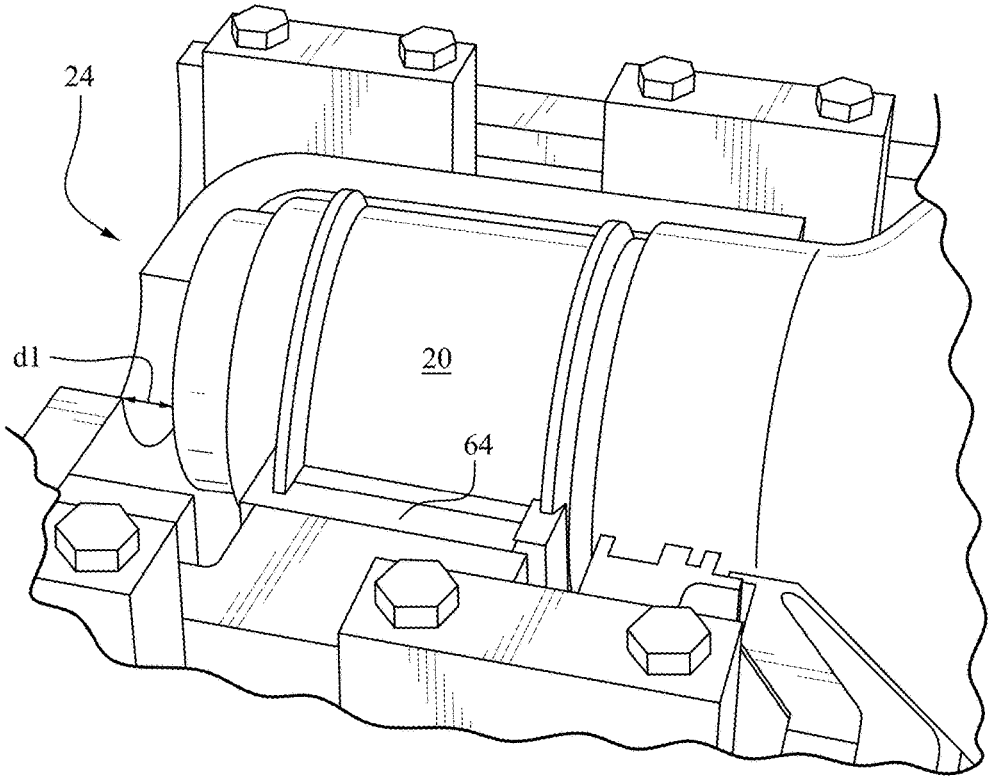
FIG. 6 is a perspective view showing a portion of an aft end of a gas turbine according to an example of the disclosed technology.

Unlike the jacking position at the forward end 22 of rotor 20, the jacking position at the aft end 24 is near an end portion of the rotor, as can be seen in FIG. 6. Additionally, a small clearance space d1 exists between the end of the rotor 20 and surrounding support structure. Also, a large space exists below the rotor 20 at the jacking position, such that a semicircular saddle may simply fall away from the rotor.

Figure 5:
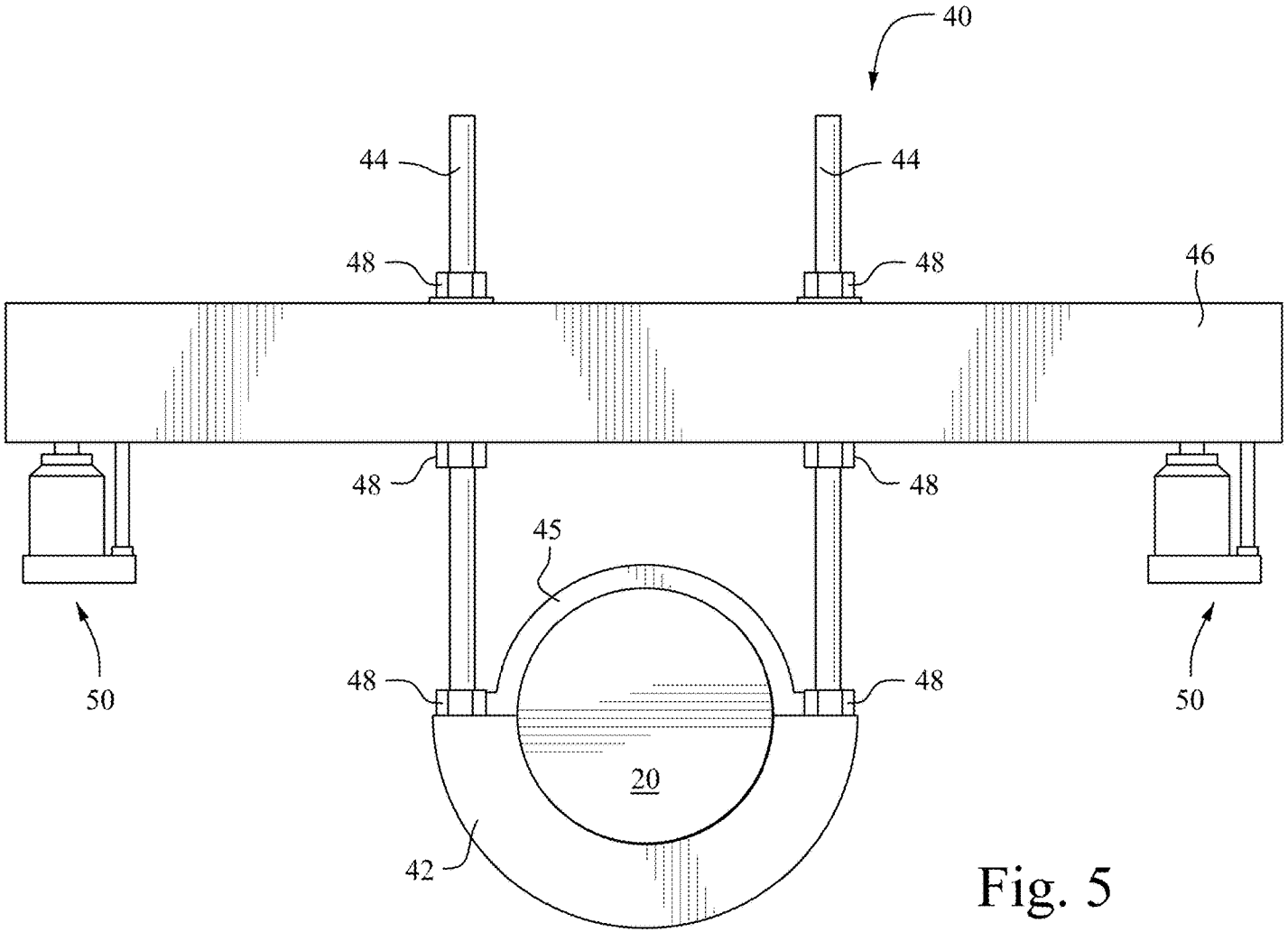
FIG. 5 is a perspective view of another jacking assembly according to an example of the disclosed technology.
Figure 7:
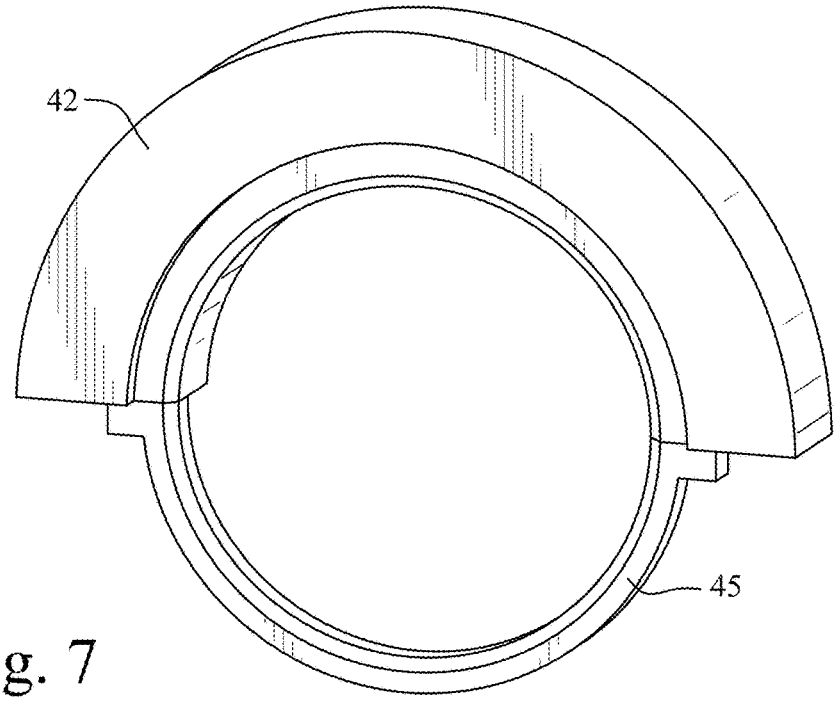
FIG. 7 is a perspective view of a saddle according to an example of the disclosed technology.
Figure 8:
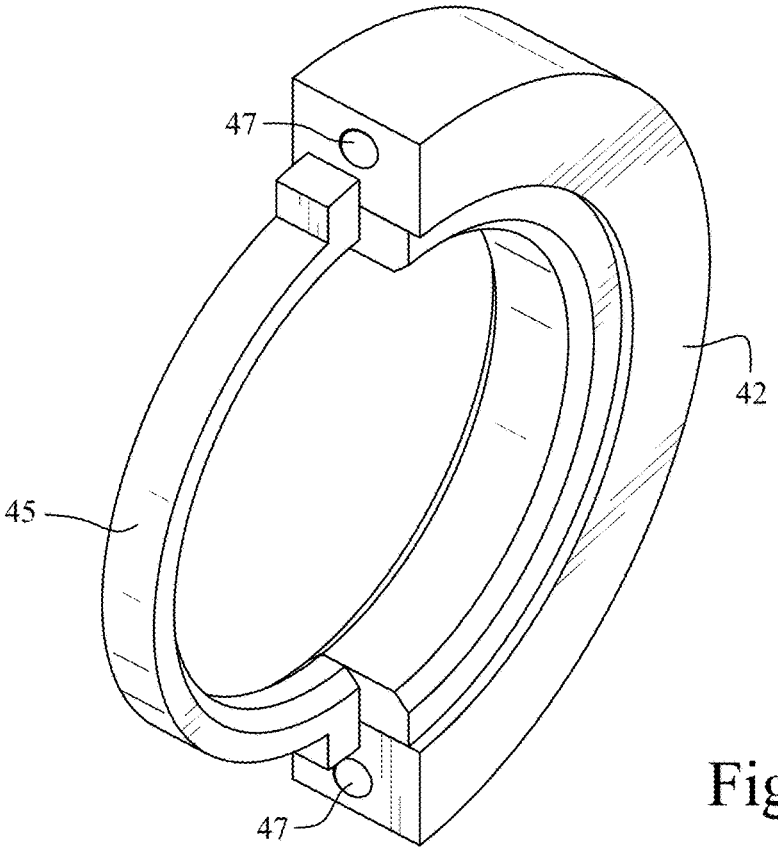
FIG. 8 is another perspective view of the saddle of FIG. 7.

As such, a saddle 42 having an arc-shaped retaining member 45 attached thereto is utilized for jacking up the aft end 24 of rotor 20, as shown in FIGS. 5, 7 and 8. Saddle 42 is similar to saddle 32. The retaining member 45 is connected to the saddle 42. In the illustrated example, the retaining member 45 has a semicircular shape and has opposing ends connected respectively to opposite ends of the saddle.

Similar to forward end jacking assembly 30, aft end jacking assembly 40 includes connectors 44 (e.g., threaded rods), a lifting beam 46, retaining members (e.g., nuts 48) and lifting devices (e.g., mechanical jacks 50), as shown in FIG. 5.

Figure 9:
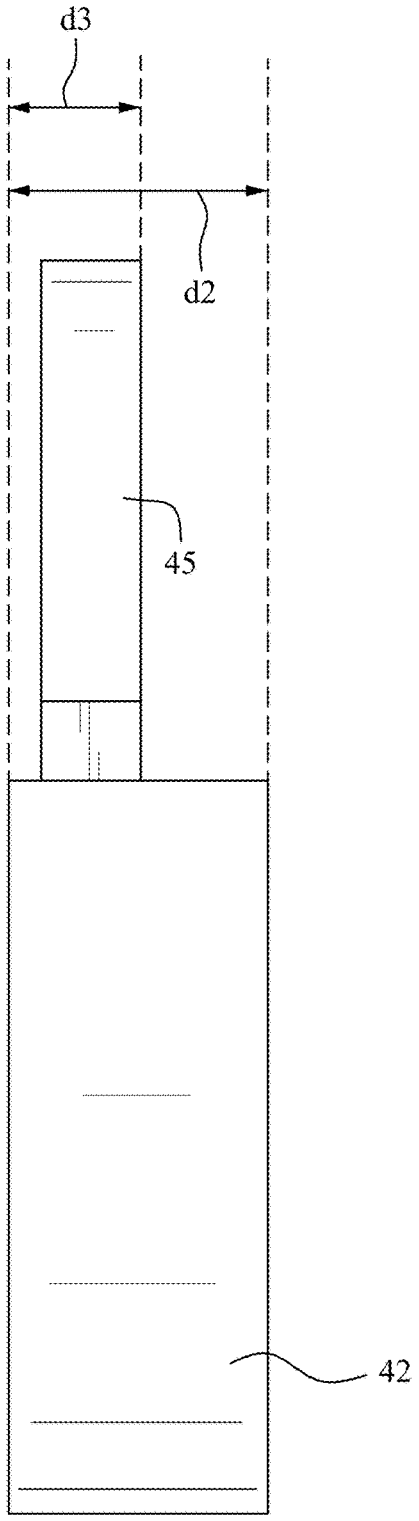
FIG. 9 is a side view of the saddle of FIG. 7.

As shown in FIG. 9, saddle 42 has a width d2. An aft edge of the retaining member 45 is positioned a distance d3 from a forward edge of the saddle. As can be seen in FIG. 9, d3 is smaller than d2. Referring to FIGS. 6 and 9, it is noted that d2 is larger than d1 while d3 is smaller than d1.

Figure 10:
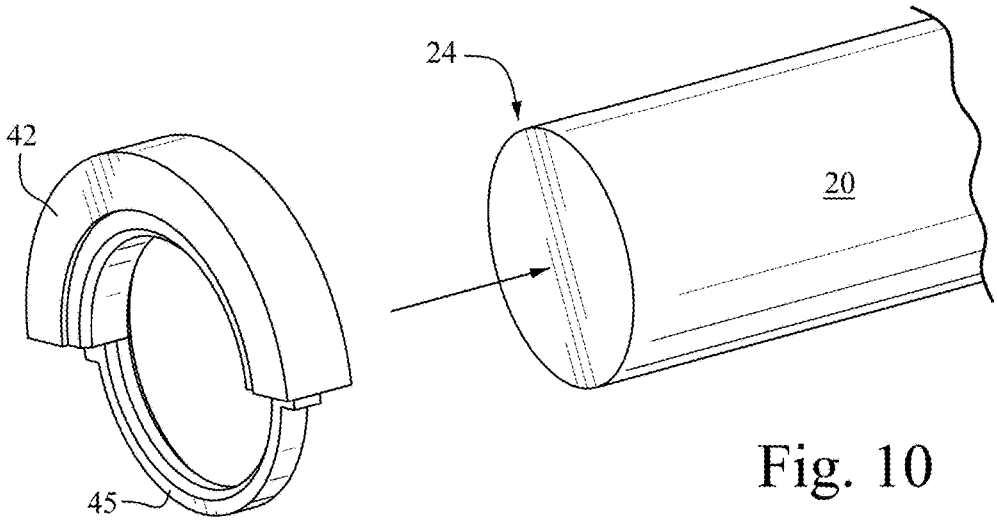
FIG. 10 is a perspective view of the saddle of FIG. 7 being installed on the aft end of the rotor according to an example of the disclosed technology.
Figure 11:
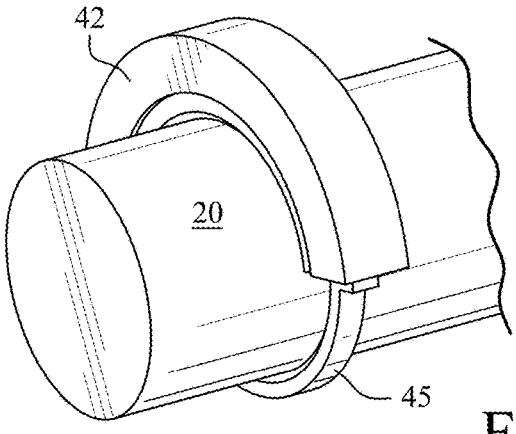
FIG. 11 is another perspective view of the saddle of FIG. 7 being installed on the aft end of the rotor according to an example of the disclosed technology.
Figure 12:
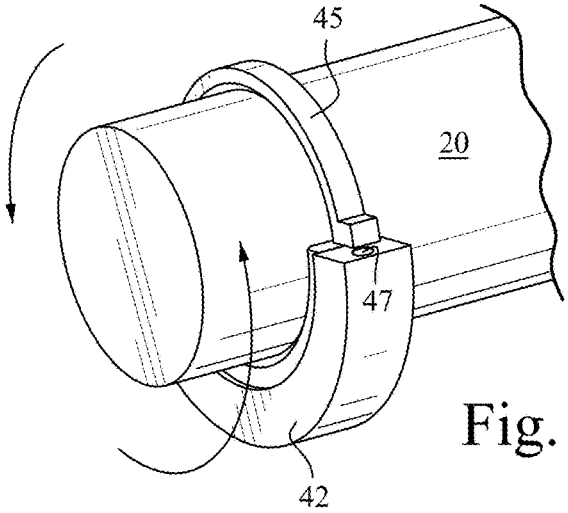
FIG. 12 is another perspective view of the saddle of FIG. 7 being installed on the aft end of the rotor according to an example of the disclosed technology.

As such, the saddle 42 is positioned on the rotor with the retaining member 45 is located downwardly so as to fit into the clearance space d1, as shown in FIGS. 10 and 11. Once positioned on the rotor, the saddle 42 and retaining member 45 are rotated to position the saddle beneath a lower portion of the rotor. The retaining member 45 is supported on an upper portion of the rotor and functions to prevent the saddle from falling away from the lower portion of the rotor. In this manner, the saddle may be positioned at the correct axial position for lifting the rotor.

Similar to the jacking assembly 30, jacking assembly 40 is configured to lift the rotor a distance of 0.008 to 0.0225 inches, preferably 0.01 to 0.02 inches. Referring to FIG. 6, while the rotor is lifted, the lower half 64 of the journal bearing (bearing #2) at the aft end of the rotor may be removed, inspected or replaced. As mentioned above, a major inspection may also be performed on the turbine.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A rotor jacking system for a turbine or generator, comprising:

a rotor rotatably disposed in a turbine or generator; and a jacking assembly comprising:

an arc-shaped saddle configured to extend around and support a lower portion of the rotor without removing the rotor from the turbine or generator, the saddle having two blind holes formed therein;

a lifting beam configured to extend over the rotor transversely to an axial direction of the rotor, the lifting beam being axially aligned with the arc-shaped saddle; and two connectors disposed on respective lateral sides of the rotor, each connector extending between and being attached respectively to the lifting beam and the arc-shaped saddle such that the arc-shaped saddle is positioned spaced-apart from the lifting beam, the connectors being received, respectively, in the two blind holes without passing through a rear side of the saddle, wherein one or both of the two connectors is configured to facilitate rotating the saddle around the rotor, while the rotor is disposed in the turbine or generator, until the saddle is positioned beneath the lower portion of the rotor, and wherein the saddle is configured to lift the rotor vertically when the lifting beam is displaced vertically.

2. The rotor jacking system of claim 1, further comprising two lifting devices disposed on respective lateral sides of the rotor, each lifting device configured to support a portion of the lifting beam.

3. The rotor jacking system of claim 2, wherein each lifting device is configured to move vertically so as to displace vertically the lifting beam.

4. The rotor jacking system of claim 3, wherein the two lifting devices are mechanical jacks.

5. The rotor jacking system of claim 1, wherein the arc-shaped saddle has a semicircular shape.

6. The rotor jacking system of claim 1, wherein the two connectors are threaded rods.

7. The rotor jacking system of claim 6, wherein the two connectors are coupled to the lifting beam by retaining members.

8. The rotor jacking system of claim 7, wherein the retaining members are nuts received on the threaded rods.

9. The rotor jacking system of claim 1, wherein the lifting beam in configured to be displaced vertically so as to lift the rotor a distance of 0.008 to 0.0225 inches.

10. The rotor jacking system of claim 9, wherein the lifting beam in configured to be displaced vertically so as to lift the rotor a distance of 0.01 to 0.02 inches.

11. The rotor jacking system of claim 1, further comprising an arc-shaped retaining member connected to the saddle and configured to extend around an upper portion of the rotor so as to hold the saddle beneath the lower portion of the rotor.

12. The rotor jacking system of claim 1, wherein each connector has a first end directly attached to the arc-shaped saddle.

13. A gas turbine system, comprising:

a compressor section;

a turbine;

a thrust cage cavity; and a rotor jacking system, comprising:

a rotor rotatably disposed in the turbine; and a jacking assembly comprising:

an arc-shaped saddle configured to extend around and support a lower portion of the rotor without removing the rotor from the turbine, the saddle having two blind holes formed therein;

a lifting beam configured to extend over the rotor transversely to an axial direction of the rotor, the lifting beam being axially aligned with the arc-shaped saddle; and two connectors disposed on respective lateral sides of the rotor, each connector extending between and being attached respectively to the lifting beam and the arc-shaped saddle such that the arc-shaped saddle is positioned spaced-apart from the lifting beam, the connectors being received, respectively, in the two blind holes without passing through a rear side of the saddle, wherein one or both of the two connectors is configured to facilitate rotating the saddle around the rotor, while the rotor is disposed in the turbine, until the saddle is positioned beneath the lower portion of the rotor, and wherein the saddle is configured to lift the rotor vertically when the lifting beam is displaced vertically, wherein the rotor is coupled to the compressor section and the turbine, and wherein the saddle is positioned in the thrust cage cavity.

* * * * *